US008936170B2

(12) United States Patent
Dyer et al.

(10) Patent No.: US 8,936,170 B2
(45) Date of Patent: Jan. 20, 2015

(54) CONTAINER AND LID ASSEMBLY

(71) Applicant: American Sugar Refining, Inc., Yonkers, NY (US)

(72) Inventors: W. Richard Dyer, Boynton Beach, FL (US); James T. Krause, II, Delray Beach, FL (US)

(73) Assignee: American Sugar Refining, Inc., Yonkers, NY (US)

( * ) Notice: Subject to any disclaimer, the term of this patent is extended or adjusted under 35 U.S.C. 154(b) by 0 days.

(21) Appl. No.: 13/910,820

(22) Filed: Jun. 5, 2013

(65) Prior Publication Data

US 2014/0361011 A1 Dec. 11, 2014

(51) Int. Cl.

*B65D 51/18* (2006.01)
*B65D 47/20* (2006.01)
*B65D 47/08* (2006.01)

(52) U.S. Cl.

CPC ..... *B65D 47/20* (2013.01); *B65D 47/0895* (2013.01)
USPC ..... 220/254.3; 220/254.7; 220/351

(58) Field of Classification Search

CPC ..... B65D 47/0895; B65D 47/089; B65D 47/0861; B65D 47/0876; B65D 47/0857; B65D 2543/00972; B65D 2543/00046; B65D 39/02; B65D 50/069; A47G 19/22; A47G 19/2272
USPC ..... 220/253, 254.1, 254.3, 254.4, 254.7, 220/259.1, 259.5, 351, 360
See application file for complete search history.

(56) References Cited

U.S. PATENT DOCUMENTS

| | | | | |
|---|---|---|---|---|
| 5,927,535 | A * | 7/1999 | Goth | 220/254.3 |
| 6,763,964 | B1 * | 7/2004 | Hurlbut et al. | 220/254.3 |
| 7,594,588 | B2 * | 9/2009 | Auer | 220/326 |
| 7,595,029 | B2 | 9/2009 | Welp | 422/129 |
| 7,959,029 | B2 * | 6/2011 | Whitaker et al. | 220/719 |
| 8,276,776 | B2 * | 10/2012 | Roth et al. | 220/254.4 |
| 2010/0213221 | A1 * | 8/2010 | Vogel et al. | 222/505 |
| 2012/0241453 | A1 * | 9/2012 | Palmer | 220/254.3 |

FOREIGN PATENT DOCUMENTS

| | | |
|---|---|---|
| EP | 002334524-0001 | 1/2014 |
| EP | 002334524-0002 | 1/2014 |
| EP | 002334524-0003 | 1/2014 |
| EP | 002334524-0004 | 1/2014 |

OTHER PUBLICATIONS

International Search Report and Written Report dated Jul. 11, 2014 for International Patent Application No. PCT/US14/40802, which was filed on Jun. 4, 2014 (1st Named Inventor—Dyer; Applicant—American Sugar Refining, Inc.; (14 pages).

* cited by examiner

*Primary Examiner* — Anthony Stashick
*Assistant Examiner* — Mollie Llewellyn
(74) *Attorney, Agent, or Firm* — Ballard Spahr LLP

(57) ABSTRACT

A container and lid assembly are provided. The lid assembly has a base configured to engage an opening of the container. A hole in the base allows access to an interior chamber of the container. A surface extends upwardly and outwardly from the hole to act as a funnel to direct material towards the hole. A cover is rotatably coupled to the base to allow selective access to the hole.

25 Claims, 7 Drawing Sheets

CONTAINER AND LID ASSEMBLY

FIELD OF THE INVENTION

Provided are containers and lid assemblies for containers. More specifically, provided are containers having a lid assembly that is selectively openable for easily pouring a material from the container.

BACKGROUND

Conventional lid assemblies for containers have a selectively openable lid configured to allow a material to be poured from the container. A problem with conventional lid assemblies, however, is that the lid can be difficult and/or slow to open. For example, some lids screw onto a container and can take several seconds or more to open the lid. Moreover, with conventional lids, it can be difficult for a user of the container to direct the flow and/or volume of material being poured from the container. Further, conventional lid assemblies do not provide self-cleaning mechanisms, in which material spilled from the container onto the lid assembly can be directed back into the container. Thus, material can remain on the lid as waste and can accumulate to cause the lid assembly to not function properly.

In view of the preceding, there is a need for a lid assembly for a container that allows a user to easily, selectively direct a material from the container while restricting the buildup of the material on the container.

SUMMARY

In accordance with the purpose(s) of this invention, as embodied and broadly described herein, this invention, in one aspect, relates to containers and lid assemblies for the containers.

The lid assembly comprises a base adapted to engage and interfit within an opening of the container and a rotatable cover coupled to the base. In use, the cover can be rotated about and between an open position to expose a hole in the base and a closed position in which access to the hole is restricted.

In one aspect, the base comprises a first panel having first and second surfaces angularly oriented relative to one another. In another aspect, the first and second surfaces can cooperate to form a bridge wall that separates a front section of the base from rear section of the base. In this aspect, the bridge wall can prevent or restrict the undesired flow of material from the front section of the base to the rear section. A hole can be defined in a portion of the first panel, for example, in the front section of the first panel. The hole can place an upper surface of the base in fluid communication with an opposed lower surface of the base. In one aspect, the first surface can be positioned between the hole and the second surface.

The base further comprises a sidewall attached to and surrounding the first panel. In one aspect, the sidewall can be adapted to engage the opening of the container to couple the base to the container and to prevent or restrict the undesired escaping of material between the container and the base. In another aspect, the sidewall can define a well configured to mount the cover therein. For example, a plurality of bores can be defined in the sidewall configured to matingly engage a pair of pins of the cover.

In one aspect, the base further comprises a third surface that can at least partially surround the hole. The third surface can form a funnel to direct material towards the hole of the base. That is, the third surface can taper from the hole upwardly and away from the hole to an upper edge of the third surface. In one aspect, the upper edge of the third surface can be substantially concentric with the hole.

The cover comprises an upper surface, an opposed lower surface and a cover wall extending between the upper and lower surfaces of the cover. The lower surface can be configured to engage at least one of the first and second surfaces of the first panel when the cover is in the closed position.

Each pin of the pair of pins can have a distal surface facing away from the cover. In one aspect, at least a portion of each distal surface can be at an acute angle relative to the cover wall. That is, at least a portion of the distal surface of each pin can taper downwardly to direct the flow of material away from the pin/bore engagement.

The cover can be mounted within the well in spaced relation from and overlying the first panel of the base. The pins of the cover can be at least partially inserted into the bores of the base so that the cover can rotate about a pivot axis relative to the base. In use, a user of the lid assembly can selectively rotate the cover to the open position to aloe the user easy access to the hole of the base and the contents of the container.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

Figure 4:
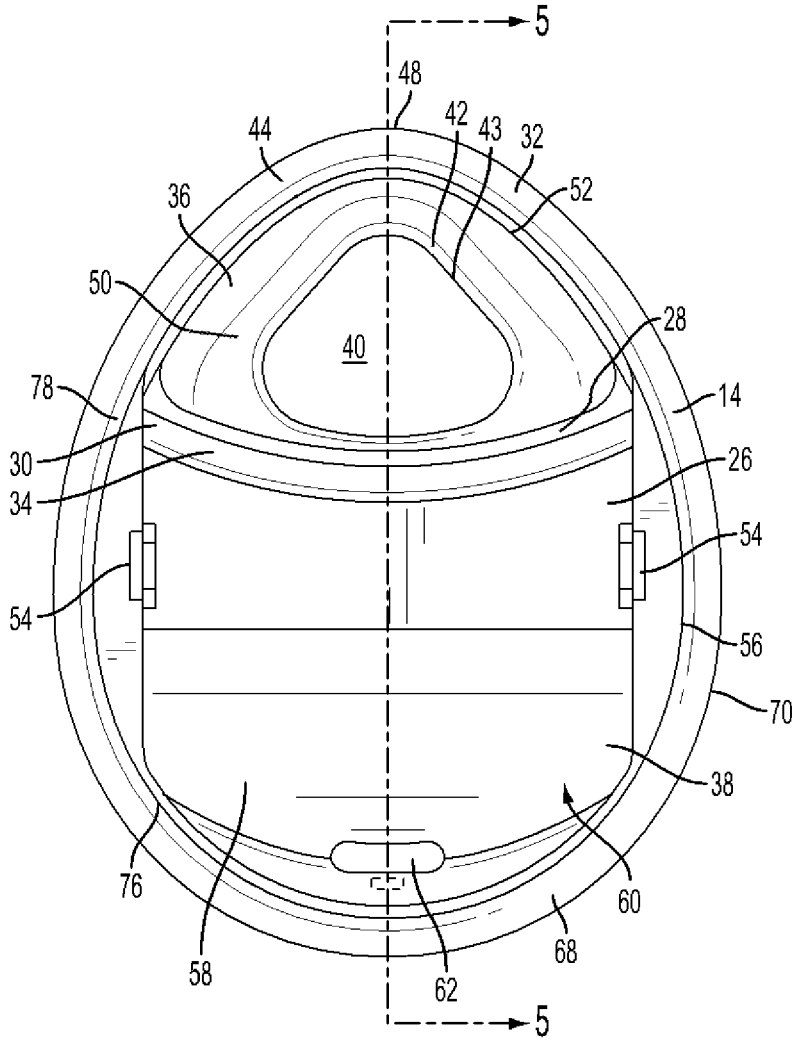
FIG. 4 is a top plan view of the base of FIG. 3.
Figure 5A:
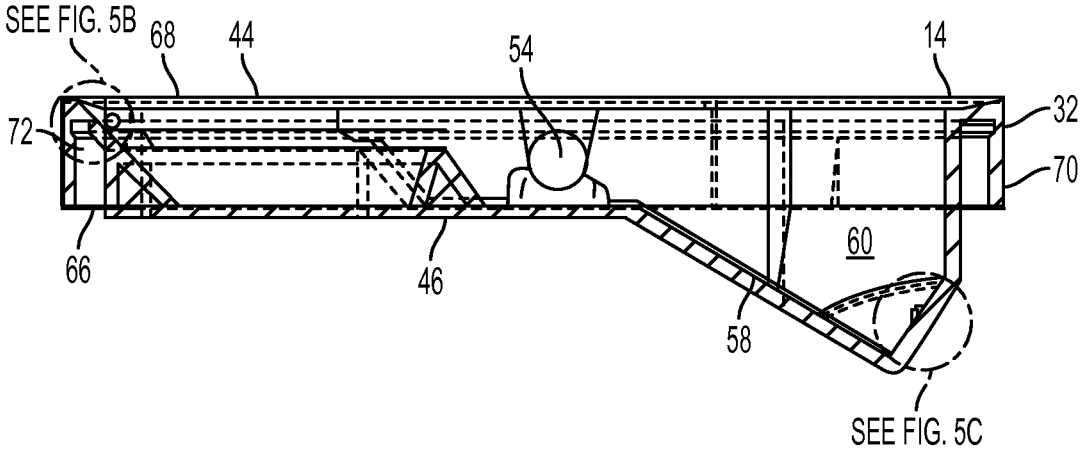
Figure 5B:
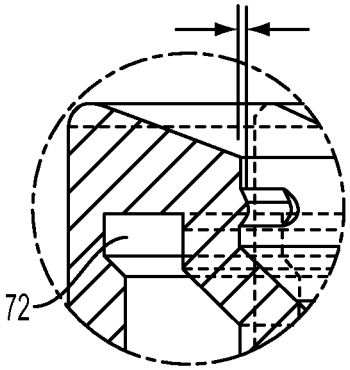
Figure 5C:
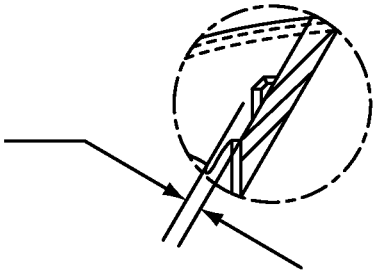

FIG. 5A is a cross-sectional elevational view of the base of FIG. 4, taken along line 5-5 of FIG. 4. FIG. 5B is a close-up view of the groove defined in the proximal edge of the sidewall of the base depicted in FIG. 5A. FIG. 5C is a close-up view of a portion of the base of FIG. 5A that defines a cavity for receiving a portion of the cover.

Figure 1:
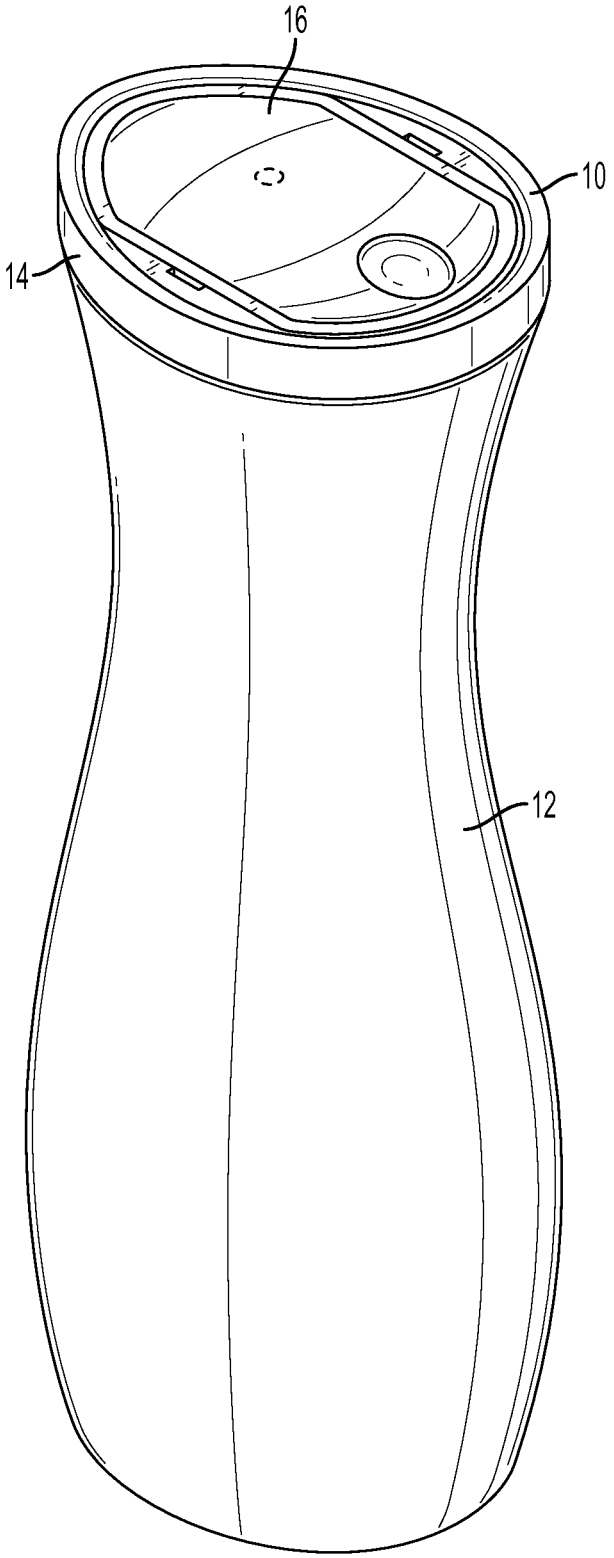
FIG. 1 is a perspective view of a container having a lid assembly attached, according to one aspect.
Figure 6:
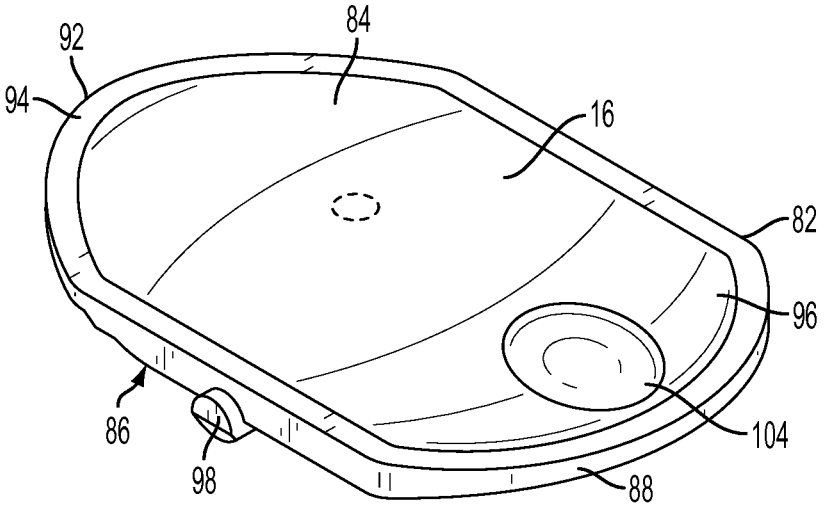

FIG. 6 is a perspective view of a cover of the lid assembly of FIG. 1, according to one aspect.

Figure 7:
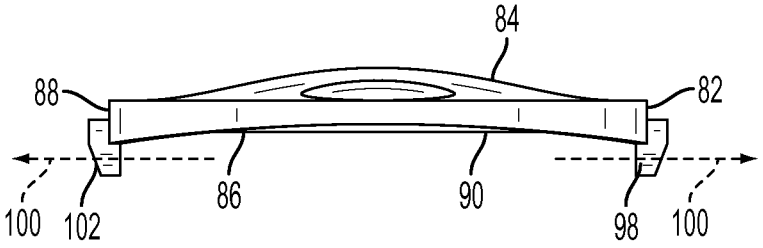

FIG. 7 is a front elevational view of the cover of FIG. 6.

DETAILED DESCRIPTION OF THE INVENTION

Embodiments of the present invention can be understood more readily by reference to the following detailed description, examples, drawing, and claims, and their previous and following description. However, before the present devices, systems, and/or methods are disclosed and described, it is to be understood that embodiments described herein are not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the invention in its best and currently known embodiments. To this end, those skilled in the relevant art will recognize and appreciate that many changes can be made to the various aspects of the invention described herein, while still obtaining the beneficial results of the described embodiments. It will also be apparent that some of the desired benefits of the embodiments of the present invention can be obtained by selecting some of the features described herein without utilizing other features. Accordingly, those who work in the art will recognize that many modifications and adaptations are possible and can even be desirable in certain circumstances and are a part of the embodiments of the present invention. Thus, the following description is provided as illustrative of the principles of the embodiments of the present invention and not in limitation thereof.

As used throughout, the singular forms "a," "an" and "the" include plural referents unless the context clearly dictates otherwise. Thus, for example, reference to "a bore" can include two or more such bores unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where the event or circumstance occurs and instances where it does not.

Referring now to FIG. 1, a lid assembly 10 for a container 12 is provided. In one aspect, the lid assembly comprises a base 14 configured to matingly engage the container and a cover 16 mounted to and overlying at least a portion of the base. In use, as will be described more fully below, the cover can be selectively rotated by a user to access to the contents of the container.

The container 12 can be configured for containing a substance. In one embodiment, the substance can be powder, such as, for example and without limitation, sugar. It is contemplated, however, that the container can also be used to contain liquids, granular solids and/or any other substance capable of being poured. For convenience and clarity, the term "powder" will be used with respect to the description of various embodiments herein; however, the use of this term is not intended to be limiting, and it is to be understood that various substances are contemplated in place of or in addition to such powders.

Figure 2:
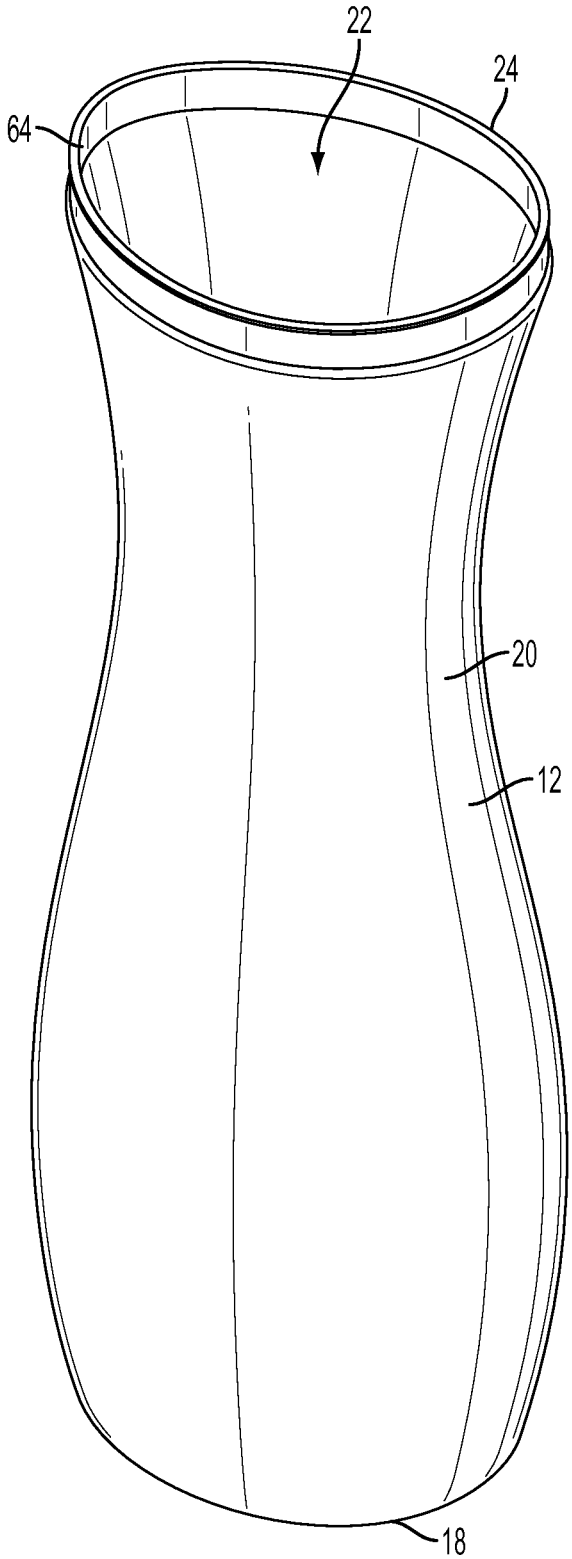
FIG. 2 is a perspective view of the container of FIG. 1.
Figure 3:
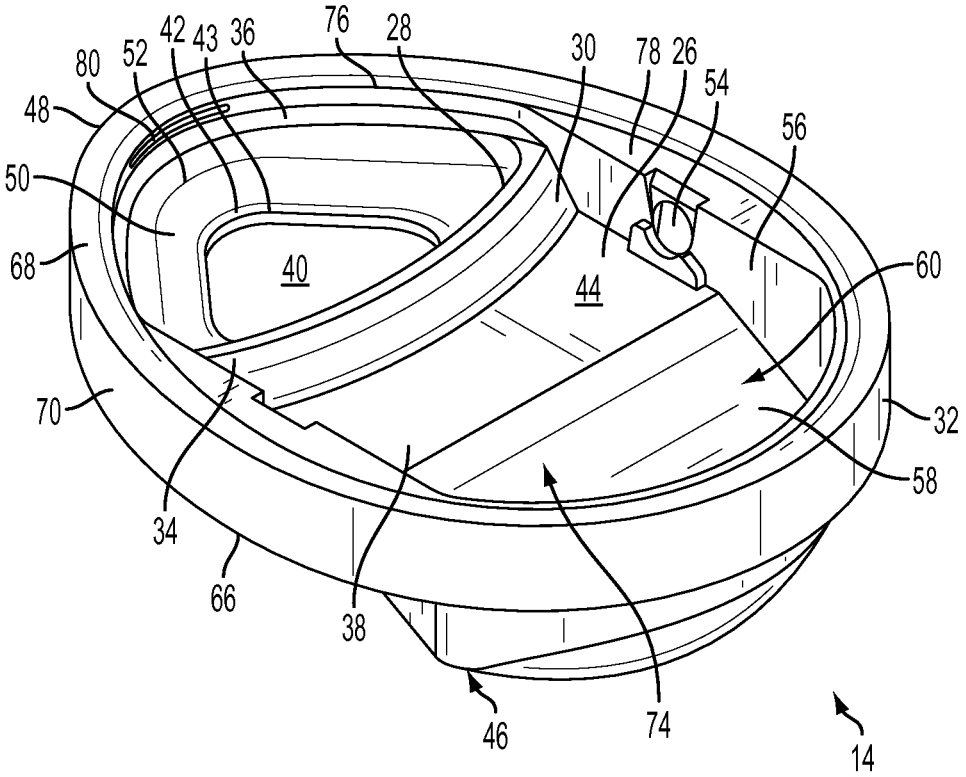
FIG. 3 is a perspective view of a base of the lid assembly of FIG. 1, according to one aspect.

With reference to FIG. 2, the container 12 can be a container having a bottom surface 18 and at least one container wall 20 extending from the bottom surface to define an interior chamber 22. An opening 24 of the container can provide access to the interior chamber. In one aspect, the opening can be substantially circular. Alternatively, in other aspects, the opening 24 can be substantially oval, square, rectangular, triangular, or any other shape.

One embodiment of the base 14 of the lid assembly 10 is illustrated in FIGS. 3-5C. The base 14 can comprise a first panel 26 having a first surface 28 and a second surface 30, and a sidewall 32 attached to and surrounding the first panel. At least a portion of the first panel 26 can be positioned in a base plane. In one aspect, the first surface 28 and the second surface 30 can be angularly oriented relative to one another to form a bridge wall 34. For example, the first surface 28 can be positioned at a first acute angle relative to the base plane, and the second surface can be positioned at a second acute angle relative to the base plane that is less than, equal to, or greater than the first acute angle. In this aspect, the bridge wall 34 can separate a front section 36 of the base 14 from a rear section 38 of the base. In another aspect, at least a portion of the sidewall 32 can be positioned in a sidewall plane substantially transverse to the base plane.

A hole 40 can be defined in a portion of the first panel 26. In one aspect, the hole can be defined in a portion of the first panel positioned in the front section 36 of the base 14. In another aspect, an outer wall 42 of the hole can extend from an outer edge 43 on an upper surface 44 of the base to an opposed lower surface 46 of the base. In this aspect, the hole can place the upper surface of the base in fluid communication with the lower surface of the base 14. In another aspect, the hole can be substantially triangular in cross-sectional shape. In this aspect, a corner of the triangular shape of the hole can be oriented towards a frontmost portion 48 of the base. Alternatively, in other aspects, the hole 40 can be substantially oval, circular, square, rectangular, or any other shape. As can be appreciated, the shape of the hole can be determined to maximize the area of the hole 40 to reduce clogging of the hole due to clumps formed in the powder being dispensed from the container 12. In one aspect, the hole can be shaped to provide a reference orientation for a user and/or for use during manufacturing. In another aspect, the hole can be positioned such that the first surface 28 of the base 14 is positioned between the hole 40 and the second surface 30.

The base 14 can further comprise a third surface 50 at least partially surrounding the hole 40. In one aspect, the third surface has an upper edge 52 spaced a predetermined distance from the hole. In another aspect, at least a portion of the third surface can be positioned at a third acute angle relative to the base plane that is less than, equal to, or greater than the first acute angle and/or the second acute angle. In another aspect, the third surface can extend upwardly and outwardly away from the outer wall 42 of the hole 40 to the upper edge 52 of the third surface. The third surface 50 can act as a funnel to direct powder towards the hole. In yet another aspect, the upper edge of the third surface can be substantially concentric with the hole 40. In another aspect, the upper edge 52 of the third surface and the outer wall 42 of the hole can be similar in shape when viewed from above as in FIG. 4. That is, the upper edge of the third surface 50 and the outer wall of the hole 40 can have substantially the same shape (though a different size) when viewed from above. In a further aspect, the third surface 50 can extend from the outer wall of the hole upwardly and outwardly away from the hole at a substantially constant angle relative to the base plane. Optionally, a first portion of the third surface can extend upwardly and outwardly at a first angle relative to the base plane, and a second portion of the third surface 50 can extend upwardly and outwardly at a second angle relative to the base plane 32. As illustrated in FIG. 4, in one aspect, the first surface 28 and the third surface can be integrally formed such that they are continuous with each other. Alternatively, the first surface can be spaced from or discontinuous with the third surface 50.

With reference again to FIG. 3, a pair of bores 54 can be defined in opposing portions of an inner surface 56 of the sidewall 32. In one aspect, each bore of the pair of bores 54 can be defined in a portion of the sidewall in the rear section 38 of the base 14. In another aspect, each bore of the pair of bores 54 can be substantially cylindrical in shape.

The base 14 can further comprise a fourth surface 58 positioned in the rear section of the 38 of the base. In one aspect, at least the fourth surface and a portion of the inner surface 56 of the sidewall 32 can cooperate to form a cavity 60 defined in the base. In a further aspect, the fourth surface 58 can be a substantially planar surface. In still another aspect, the fourth surface can extend downwardly at a substantially constant fourth acute angle relative to the base plane. Alternatively, in other aspects, the fourth surface can extend downwardly at a plurality of angles relative to the base plane. It is contemplated that the fourth acute angle can be less than, equal to, or greater than the first acute angle, the second acute angle, and/or the third acute angle. The cavity 60 can be sized and shaped to receive at least a portion of the cover 16 therein, as described more fully below.

In one aspect, an aperture 62 can be defined in a lower portion of the cavity 60 of the base 14, as illustrated in FIG. 4. In this aspect, the aperture can extend from the upper surface 44 of the base to the opposed lower surface 46 of the base. The aperture 62 can place the upper surface of the base in fluid communication with the lower surface of the base 14. In another aspect, the aperture can be sized and shaped so that any powder present in the cavity can drain through the aperture 62 into the container 12.

The sidewall 32 of the base 14 can be configured to matingly engage a distal end 64 of the container wall 20 of the container 12 (as illustrated in FIG. 2) and seal the opening 24 of the container. With reference to FIGS. 5A-5C, the sidewall can comprise a proximal edge 66 and an opposed distal edge 68. In one aspect, the distal edge of the sidewall 32 can be substantially parallel to the base plane and substantially normal relative to an outer surface 70 of the sidewall. In another aspect, the distal edge 68 of the sidewall 32 can be at an acute angle relative to the outer surface of the sidewall. For example, the distal edge 68 can taper downwardly from the outer surface 70 to the inner surface of the sidewall 32. This taper can direct powder from the sidewall towards the hole 40.

In one aspect, and with reference to FIGS. 5A-5B, a groove 72, a notch, and the like can be defined in a portion of the proximal edge 66 the sidewall 32 configured to matingly engage an end of the container wall 20. In this example, a tab or lip can be formed on at least a portion of the distal end 64 of the container wall configured to matingly engage the groove 72 or notch of the base 14.

In one aspect, the outer surface 70 of the sidewall 32 of the base 14 can be sized and shaped to correspond to at least a portion of the distal end of the container wall 20. For example, when the base is matingly engaged with the container 12, a portion of the distal end 64 of the container wall and the outer surface of the sidewall of the base can be substantially the same shape and size so that the base and 14 and the container 12 can appear to be "seamlessly attached." That is, when the base is matingly engaged with the container, the distal end of the container wall 20 and the outer surface 70 of the sidewall 32 can have substantially the same diameter.

Referring again to FIGS. 3 and 4, in one aspect, the sidewall 32 can surround the first panel 26 and can define a recessed well 74. In this aspect, the well can be a recessed portion of the sidewall configured to mount the cover 16 therein. For example, a shoulder 76 can be formed around at least a portion of the distal edge 68 of the inner surface 56 of the sidewall. The shoulder can form an engagement surface 78 of the well 74 configured to engage at least a portion of the cover.

A detent 80 can be defined in a portion of the inner surface 56 of the sidewall 32. In one aspect, the detent can defined in a portion of the inner surface of the sidewall that is positioned in the front section of the base 14. In another aspect, the detent 80 can be defined in a portion of the inner surface of the sidewall that is positioned in the frontmost of the base 14. The detent can be sized and shaped to matingly engage a portion of the cover 16 as described more fully below.

The cover 16 can be configured to mount therein the well 74 of the base 14 and is illustrated in FIGS. 6 and 7. In one aspect, the cover can be sized and shaped so that when attached to the base, the cover 16 overlies at least a portion of the shoulder 76 of the distal edge 68 of the sidewall 32. In another aspect, the cover can be sized so that when attached to the base 14, an outer edge 82 of the cover 16 is substantially flush with at least a portion of the sidewall 32 of the base. For example, the outer edge 82 of the cover can be sized and shaped slightly smaller than an outer perimeter of the recessed well 74. In still another aspect, the cover can be sized so that when attached to the base 14, the cover overlies the hole 40 and the aperture 62 of the base.

The cover 16 comprises an upper surface 84, an opposed lower surface 86, and a cover wall 88 extending between the upper and lower surfaces. In one aspect, the lower surface 86 comprises a second panel 90 configured to be positioned in spaced relation from and overlying the first panel 26. In this aspect, at least a portion of the second panel can be positioned opposite to the first and second surfaces 28, 30 of the first panel, and at least a portion of the second panel can engage at least one of the first and second surfaces of the first panel 26 when the cover is in the closed position. In another aspect, a portion of the cover 16 can form a tab 92 configured to matingly engage the detent 80 of the sidewall 32 of the cover. For example, a forward section 94 of the cover can be shaped to matingly engage the detent. In yet another aspect, at least a portion of a rearward section 96 of the cover can be sized and shaped to fit therein the cavity 60 of the base.

The cover 16 further comprises a pair of pins 98 extending from a portion of the cover wall 88. In one aspect, each pin of the pair of pins can extend outwardly from opposing portions of the cover wall. Each pin is adapted to be received by a respective bore 54 of the pair of bores of the base 14. In another aspect, the pair of pins can be substantially aligned along a pivot axis 100. In use, as described more fully below, the cover 16 can be selectively rotated relative to the base about the pivot axis. In still another aspect, the pivot axis 100 can be located below the lower surface 86 of the cover. Alternatively, the pivot axis can be located above or substantially aligned with the lower surface of the cover 16. In one aspect, the pivot axis 100 can be substantially parallel to the base plane.

Each pin 98 of the pair of pins can be substantially cylindrical having a distal surface 102 facing away from the cover 16. It is of course contemplated that each pin can have other shapes, such as substantially oval and the like when viewed in cross-section. In one aspect, the distal surface of each pin can be substantially parallel to the cover wall 88. In another aspect, at least a portion of the distal surface 102 of each pin can be substantially parallel to the cover wall. In another aspect, the distal surface can be at an acute angle relative to the cover wall 88 such that the distal surface 102 tapers inwardly from the upper surface 84 towards the lower surface 86 of the cover 16. As can be appreciated, this taper can urge powder to drop from the distal surface of the respective pin. In yet another aspect, a portion of the distal surface 102 of each pin 98 can be substantially parallel to the cover wall, and a portion of the distal surface can be at an acute angle relative to the cover wall.

To assemble the lid assembly 10, the cover 16 can be positioned therein the well 74 of the base assembly so that each pin of the pair of pins 98 can be positioned in a respective bore 54 of the pair of bores of the base 14. The pins and bores can cooperate to allow the cover rotate relative the base. The lid assembly 10 can be coupled to a container 12 by engaging the groove 72 or notch of the proximal edge 66 the sidewall 32 of the base 14 with the end of the container wall 20. As can be appreciated, the lid assembly can "snap" to the container to prevent or restrict powder from escaping the container between the container 12 and the base.

In one aspect, an indentation 104 can be defined in a portion of the upper surface 84 of the cover 16. The indentation can be configured to provide a user of the lid assembly 10 with a suggested position to place a finger of the user on the cover.

In one aspect, the cover 16 can be selectively rotatable relative to the base about and between an open position in which access to the hole 40 is provided, and a closed position in which access to the hole is restricted. In the closed position, in one aspect, the tab 92 of the forward section 94 of the cover 16 can engage the detent 80 of the base 14. The engagement of the tab and the detent can prevent inadvertent opening of the cover. In one aspect, the engagement of the tab 92 and the detent 80 can provide a user of the lid assembly 10 both a tactile feeling and an audible click to indicate that the tab has engaged the detent. In another aspect, in the closed position, at least a portion of the lower surface 86 of the cover 16 can engage or otherwise rest on engagement surface 78 formed by the shoulder 76 of the base. In yet another aspect, in the closed position, at least a portion of the lower surface of the cover engages at least one of the first and second surfaces 28, 30 of the first panel 26. In this aspect, the lower surface 86 of the cover 16, the bridge wall 34, the inner surface 56 of the sidewall 32, and/or the third surface can form a containment chamber that prevents or restricts undesirable flow of powder outside of the containment chamber. That is, the containment chamber can be formed in the front section 36 of the base 14 and cover 16 to prevent or restrict the flow of powder outside of the containment chamber and to, for example, the rear section 38 of the base.

In the open position, at least a portion of the lower surface 86 of the cover 16 can be rotated to a predetermined distance from the first panel 26 of the base 14. In one aspect, in the open position, at least a portion of the forward section 94 of the cover can be spaced from the first panel of the base so that the hole 40 of the base is accessible. As can be appreciated then, in the open position, powder from the container 12 can be accessible by flowing through the hole, and can thus be dispensed from the container. In another aspect, in the open position, the fourth surface 58 of the base 14 can prevent the cover from rotating beyond a predetermined amount. For example, as the forward section 94 of the cover 16 rotates away from the hole 40, the rearward section 96 of the cover rotates into the cavity 60 of the base. This rotation can continue until a portion of the lower surface 86 of the cover contacts the fourth surface of the base 14 to prevent over rotation of the cover 16 relative to the base. As can be appreciated, the angle of the fourth surface 58 relative to the sidewall 32 and/or the depth of the cavity can be varied as desired to adjust the amount of rotation of the forward section 94 of the cover. Further, it is contemplated that the shape and/or configuration of the lower surface 86 of the cover can be varied as desired to adjust the amount of rotation of the forward section of the cover 16. For example, the thickness of the cover can be changed to change the interference point between the cover and the fourth surface 58 so that the forward section 94 of the cover rotates a desired amount relative to the base 14.

In use, powder in the container 12 can be removed from the container by moving the cover 16 of the lid assembly 10 to the open position. For example, a user of the container can apply downward pressure to the indentation 104 defined in the upper surface 84 of the cover. This pressure can rotate the forward section 94 of the cover 16 upwardly away from the hole 40 of the base 14 so that the user can tilt the container 12 and pour powder from the container. The hole can be shaped and oriented to enable the user to easily direct the flow of powder in a desired direction. Upon completion of pouring the powder, any powder remaining on the base 14 can be urged by gravity down the funnel-shaped third surface 50 of the base and back into the hole 40. The bridge wall 34 can prevent or restrict the powder from entering the rear section 38 of the base 14. However, any powder that does enter the rear section of the base can slide down the fourth surface 58 and/or the inner surface 56 of the sidewall 32 to the aperture 62 formed in the cavity 60 and back into the container 12. Further, the angled distal surface 102 of each pin 98 of the pair of pins can urge powder away from the pin and/or bore 54 and towards the fourth surface so that the pins can be at least partially self-cleaning.

To seal the container 12 to prevent undesired removal of powder from the container or undesired access to the interior chamber 22 of the container, the user can rotate the cover 16 to the closed by position by urging the forward section 94 of the cover towards the base 14 until the tab 92 of the cover 16 engages the detent 80 of the base. An audible sound and/or a tactile feeling can signal the user that the tab has engaged the detent. In this closed position, a seal formed between the cover 16 and portions of the bridge wall 34, the inner surface 56 of the sidewall 32 and/or the engagement surface 78 of the sidewall can prevent or restrict undesired access to the interior chamber 22 of the container.

In one aspect, the lid assembly 10 can be configured to engage conventional containers 12. In another aspect, the lid assembly and a container can be formed and/or provided as an assembled unit. That is, the lid assembly 10 can be provided to a user and configured to engage a standalone container. Optionally, the lid assembly and a container can be preassembled and provided to the user as a container having a pre-assembled lid assembly 10.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A lid assembly for a container for containing a granular solid material, the container having an opening, the lid assembly comprising:

a base adapted to engage and interfit within the opening of the container, the base having a front section, a rear section, an upper surface, and an opposed lower surface, the base comprising:

a first panel having first and second surfaces angularly oriented relative to one another to form a bridge wall, wherein a hole is defined in a portion of the first panel, wherein the hole places the upper surface of the base in communication with the opposed lower surface of the base, wherein the first surface is positioned between the hole and the second surface, wherein the bridge wall separates the front section of the base from the rear section of the base, and wherein the bridge wall is configured to restrict flow of the granular solid material from the front section to the rear section of the base;

a sidewall attached to and surrounding the first panel to define a well, the sidewall adapted to engage the opening of the container;

a third surface at least partially surrounding the hole; and a fourth surface positioned in the rear section of the base, wherein the fourth surface and a portion of an inner surface of the sidewall cooperate to define a cavity in the base, wherein an aperture is defined therein the cavity, wherein the aperture is flush with the upper surface of the base and places the upper surface of the base in communication with the opposed lower surface of the base, and wherein the aperture is configured to receive any granular solid material within the cavity and return the granular solid material to the container; and a cover mounted within the well in spaced relation from and overlying the first panel, wherein the cover is selectively rotatable relative to the base about and between an open position providing access to the hole, and a closed position in which access to the hole is restricted, and wherein in the closed position, at least a portion of the cover engages at least a portion of the first panel.

2. The lid assembly of claim 1, wherein the hole has an outer edge, wherein the third surface has an upper edge distal from the outer edge of the hole, wherein the third surface extends upwardly and outwardly away from the hole to the upper edge, and wherein the third surface is configured to funnel the granular solid material toward the hole.

3. The lid assembly of claim 2, wherein the upper edge of the third surface is substantially concentric with the hole.

4. The lid assembly of claim 3, wherein the hole is substantially triangular in cross-sectional shape, and wherein the substantially triangular cross-sectional shape of the hole is configured to reduce clogging of the hole due to clumps formed in the granular solid material.

5. The lid assembly of claim 4, wherein a corner of the triangular hole is oriented towards the front section of the base.

6. The lid assembly of claim 1, wherein the cover comprises an upper surface, an opposed lower surface configured to engage at least a portion of the bridge wall when the cover is in the closed position, and a cover wall extending between the upper and lower surfaces of the cover.

7. The lid assembly of claim 6, wherein the lower surface of the cover and at least one of the bridge wall, the inner surface of the sidewall, and the third surface can form a containment chamber configured to restrict the flow of the granular solid material from the container.

8. The lid assembly of claim 1, wherein the cavity is configured to receive at least a portion of the cover therein when the cover is in the open position.

9. The lid assembly of claim 1, wherein the fourth surface extends downwardly at a substantially constant angle relative to the sidewall.

10. The lid assembly of claim 1, wherein in the closed position, an outer edge of the cover is substantially flush with at least a portion of the sidewall.

11. The lid assembly of claim 1, wherein the cover has a forward section and a rearward section, and wherein a downward force on the rearward section of the cover rotates the cover from the closed position to the open position.

12. The lid assembly of claim 1, further comprising a means for audibly signaling a user that the cover is in the closed position.

13. The lid assembly of claim 1, further comprising a means for tactilely signaling a user that the cover is in the closed position.

14. The lid assembly of claim 1, wherein the cover comprises an upper surface, an opposed lower surface configured to engage at least one of the first and second surfaces of the first panel when the cover is in the closed position, and a cover wall extending between the upper and lower surfaces of the cover, and wherein the cover comprises a pair of pins extending outwardly from opposing portions of the cover wall, wherein each pin has a distal surface facing away from the cover.

15. The lid assembly of claim 14, wherein at least a portion of each distal surface is at an acute angle relative to the cover wall.

16. The lid assembly of claim 15, wherein a pair of bores are defined in opposing portions of an inner surface of the sidewall, and wherein each bore of the pair of bores is adapted to receive a respective pin of the pair of pins of the cover such that the pins can rotate within the bores.

17. The lid assembly of claim 1, wherein the base further comprises a detent defined in a portion of the inner surface of the sidewall, wherein the detent is sized and shaped to matingly engage a portion of the cover and maintain the cover in the closed position.

18. The lid assembly of claim 1, wherein the cover comprises an upper surface, and an opposed lower surface, wherein the lower surface of the cover comprises a second panel configured to be positioned in spaced relation from and overlying the first panel of the base.

19. The lid assembly of claim 18, wherein at least a portion of the second panel engages at least one of the first and second surfaces of the first panel when the cover is in the closed position.

20. A container for containing a granular solid material, the container comprising:

a bottom surface;

at least one container wall extending upwardly from the bottom surface to define an interior chamber, wherein a distal end of the container wall defines an opening to provide access to the interior chamber; and a lid assembly configured to engage the opening, the lid assembly comprising:

a base adapted to engage and interfit within the opening of the container, the base having a front section and a rear section and comprising:

a first panel having first and second surfaces angularly oriented relative to one another to form a bridge wall, wherein a hole is defined in a portion of the first panel, wherein the hole places an upper surface of the base in communication with an opposed lower surface of the base, wherein the first surface is positioned between the hole and the second surface, wherein the bridge wall separates the front section of the base from the rear section of the base, and wherein the bridge wall is configured to restrict flow of the granular solid material from the front section to the rear section of the base;

a sidewall attached to and surrounding the first panel to define a well, the sidewall adapted to engage the opening of the container;

a third surface at least partially surrounding the hole; and a fourth surface positioned in the rear section of the base, wherein the fourth surface and a portion of an inner surface of the sidewall cooperate to define a cavity in the base, wherein an aperture is defined therein the cavity, wherein the aperture is flush with the upper surface of the base and places the upper surface of the base in communication with the opposed lower surface of the base, and wherein the aperture is configured to receive any granular solid material within the cavity and return the granular solid material to the container; and a cover mounted within the well in spaced relation from and overlying the first panel, wherein the cover is selectively rotatable relative to the base about and between an open position providing access to the hole, and a closed position in which access to the hole is restricted, and wherein in the closed position, at least a portion of the cover engages at least one of the first and second surfaces of the first panel when the cover is in the closed position.

21. The container of claim 20, further comprising a means for audibly signaling a user that that cover is in the closed position.

22. The container of claim 20, wherein the hole has an outer edge, wherein the third surface has an upper edge distal from the outer edge of the hole, wherein the third surface extends upwardly and outwardly away from the hole to the upper edge, and wherein the third surface is configured to funnel the granular solid material toward the hole.

23. The container of claim 22, wherein the upper edge of the third surface is substantially concentric with the hole.

24. The container of claim 23, wherein the hole is substantially triangular in cross-sectional shape, and wherein the substantially triangular cross-sectional shape of the hole is configured to reduce clogging of the hole due to clumps formed in the granular solid material.

25. The container of claim 20, wherein the fourth surface of the base extends downwardly at a substantially constant angle relative to the sidewall.

* * * * *